US005803996A

United States Patent [19]

Inoue et al.

[11] Patent Number: 5,803,996

[45] Date of Patent: Sep. 8, 1998

[54] ROD-SHAPED OR TUBULAR AMORPHOUS ZR ALLOY MADE BY DIE CASTING AND METHOD FOR MANUFACTURING SAID AMORPHOUS ZR ALLOY

[75] Inventors: Akihisa Inoue; Tsuyoshi Masumoto; Tao Zhang; Yoshiyuki Shinohara, all of Sendai, Japan

[73] Assignee: Research Development Corporation of Japan, Saitama-ken, Japan

[21] Appl. No.: 651,668

[22] Filed: May 21, 1996

[51] Int. Cl.[6] ..... C22F 1/18

[52] U.S. Cl. ..... 148/672; 148/58; 164/423; 164/463; 164/465

[58] Field of Search ..... 148/538, 672; 164/423, 463, 465

[56] References Cited

U.S. PATENT DOCUMENTS

| | | | |
|---|---|---|---|
| 4,148,669 | 4/1979 | Tanner et al. | 148/672 |
| 4,171,992 | 10/1979 | Tanner et al. | 148/672 |
| 4,546,816 | 10/1985 | Schwarz | 164/465 |
| 5,296,059 | 3/1994 | Masumoto et al. | 148/672 |
| 5,368,659 | 11/1994 | Peker et al. | 148/672 |

FOREIGN PATENT DOCUMENTS

| | | | |
|---|---|---|---|
| 62-137147 | 6/1987 | Japan | 148/423 |
| 3158446 | 7/1991 | Japan . | |

OTHER PUBLICATIONS

The Abstracts of The 44th Combined Lectures On Plastic Working, p. 445 (Sep. 30–Oct. 02, 1993).

The Abstracts of The 115th Seminar, Japan Metal Society, No. 907, (1994).

*Primary Examiner*—John Sheehan

*Attorney, Agent, or Firm*—Webb Ziesenheim Bruening Logsdon Orkin & Hanson, P.C.

[57] ABSTRACT

An alloy material 4 received in a melting hearth 1 is melted by high-density energy supplied from a heat source 5. The molten alloy is transferred to a forced-cooled die 3 having a cavity 2 defining the profile of a product, and quenched to an amorphous state. The alloy has the composition represented by the general formula of $Zr_{100-a-b-c}A_aB_bC_c$ (wherein the mark A represents one or more elements selected from Ti, Hf, Al and Ga, the mark B represents one or more elements selected from Fe, Co, Ni and Cu, the mark C represents one or more elements selected from Pd, Pt, Au and Ag, and the marks a–c represent the atomic ratios of respective elements A–C under the conditions of a=5–20, b=15–45, $c \leqq 10$ and a+b+c=30–70. The differential temperature region $\Delta T$ ($=T_x-T_g$) in the supercooled liquid phase of the Zr alloy represented by the difference between the crystallization point $T_x$ and the glass transition point $T_g$, is preferably 100 K or more. The obtained amorphous alloy has a rod-shaped or tubular profile having a large cross section and being excellent in plastic workability.

9 Claims, 1 Drawing Sheet

ROD-SHAPED OR TUBULAR AMORPHOUS ZR ALLOY MADE BY DIE CASTING AND METHOD FOR MANUFACTURING SAID AMORPHOUS ZR ALLOY

BACK GROUND OF THE INVENTION

The present invention relates to an amorphous Zr alloy having a large rod-shaped or tubular cross section and a die casting method of manufacturing the amorphous Zr alloy.

Zr alloys have been used as materials for an artificial fiber spinning dies, the filaments of electric lamps and so forth, since the Zr alloys exhibit excellent corrosion resitance, heat resistance and high strength. There are known ZIRCALLOY-2 (Zr-1.5 Sn-0.12 Fe-0.10 Cr-0.05 Ni) and ZIRCALLOY-4 (Zr-1.5 Sn-0.2 Fe-0.10 Cr) for such a purpose.

We have also researched the properties of those Zr alloys. In the progress of our research, we found that the Zr alloy to which a predetermined amount of Al is added together with Ni, Cu, Fe, Co and/or Mn can be metamorphised to an amorphous state by liquid-quenching, sputtering, atomizing or the like, as disclosed in Japanese Patent Application Laid-Open 3-158446. The amorphous alloy obtained in this way exhibits truly excellent properties such as hardness, strength, bending strength, heat resistance and corrosion resistance. In addition, the alloy is excellent in plastic workability, too, since its supercooled liquid phase exsists in the differential temperature range of 50 K or more.

Since the amorphous alloy remarkably reduces its viscosity in the supercooled liquid phase, it is easily shaped to the profile of a product by proper working, e.g. full enclosed die forging, at a temperature zone corresponding to the supercooled liquid phase. In this regard, we have proposed a micromachine gear made of 65% Zr-7.8% Al-7.5% Cu having thickness of a few tens $\mu$m, as disclosed in DAI 44-KAI SOSEI KAKOU RENNGOU KOUEN GAIYOU DAI 445-PAGE (The Abstracts of The 44th Combinated Lectures On Plastic Working p.445).

However, when the amorphous alloy is produced by a single roll method, a twin roll method, a gas atomizing method or the like, there is restriction on the shape of an obtained alloy. That is, the alloy obtained in these ways has the form of thin foil, flake or powder. Consequently, the obtained amorphous alloy is used only for limited purpose accounting industrial efficiency.

There is proposed a method for producing a rod-shaped amorphous Zr alloy, as disclosed DAI 115-KAI NIHON KINNZOKU GAKKAI KOUEN GAIYOU 1994 KOUEN BANGOU 907 (The Abstracts of The 115th Seminar, Japan Metal Society (1994) No.907). The proposed method uses a copper die having an opened upper surface and a rod-shaped cavity. A mother Zr alloy is melted on the copper die by arc heat, and the resultant melt is transferred along the axial direction of the rod-shaped cavity. Hereby, a rod-shaped amorphous Zr alloy is continuously produced.

The copper die proposed in DAI 115-KAI NIHON KINNZOKU GAKKAI KOUEN GAIYOU 1994 KOUEN BANGOU 907 has the rod-shaped cavity whose upper surface is opened. Due to the configuration of the die, it is impossible to control the shape of a cast body which was solidified at the part of the opened upper surface. Consequently, plastic working such as forging, extrusion or press is required in order to reform the cast body to a final shape. Besides, the die has a small surface area coming in contact with the molten Zr alloy due to the opened upper surface, so that the cooling speed of the Zr alloy is not sufficient enough to metamorphise the alloy to the amorphous state. In this point of view, the proposed die is ineffective in the formation of the amorphous state.

By the way, there have been many proposals on the modification of compositions to improve the properties of thin material such as foil or ribbon. However, the results of the researches on said modification of composition are not applicable to the case where a Zr alloy is metamorphised by the die casting method. For instance, cooling conditions are different between the die casting method and the rotary roll cooling method, as follows:

(a) In the die casting method, a molten Zr alloy is cooled from the surface parts in contact with the bottom and the both sides of the die. In the rotary roll cooling method, a molten Zr alloy is cooled unidirectionally from the surface part in contact with the surface of a roll.

(b) In the die casting method, the molten Zr alloy is kept in contact with the die for a relatively long time. In the rotary roll cooling method, the molten Zr alloy is kept in contact with the roll only for a short time.

(c) In the die casting method, the solidifying condition of the molten Zr alloy is easily influenced by oxygen or the other elements remaining in the molten alloy.

Due to these affects, conventional alloying designs are not suitable for metamorphising the Zr alloy to an amorphous state by the die casting method.

SUMMARY OF THE INVENTION

The present invention is proposed in order to solve the problems as aforementioned.

An object of the present invention is to continuously produce a rod-shaped or tubular amorphous Zr alloy having a large cross section under stable conditions. Another object of the present invention is to provide new melting-solidifying means fundamentally different from the conventional liquid-quenching method.

According to the present invention, a Zr alloy containing one or more metamorphising elements is melted in a melting hearth having an upper surface opened. The resultant molten Zr alloy is transferred to a forced-cooled die provided at the bottom of the hearth, said die having a cavity corresponding to the profile of a product. The molten Zr alloy received in the forced-cooled die is quenched and metamorphosed to an amorphous state.

The Zr alloy is heated and melted by high-frequency induction heating, arc discharge, electron beam irradiation, laser beam irradiation, infrared irradiation or the like. The forced-cooled die may be a water-cooled or gas-cooled die having a cross section of 50 $mm^2$ or more and a rod-shape or tubular cavity defining the profile of a product.

There are no restriction on the kind of the metamorphosing elements. For instance, one or more elements selected from the group consisting of Ni, Cr, Fe, Co, Pd, Pt, Hf, Au, Ag, Ti and Ga may be used as the metamorphosing elements. The amount of the metamorphosing element to be added to the Zr alloy may be properly determined accounting the cross section and/or properties of the rod-shaped or tubular product to be obtained.

In order to enhance the effect of metamorphosing to the amorphous state, the amorphous Zr alloy preferably has the composition represented by the general formula of $Zr_{100-a-b-c}A_aB_bC_c$ and the differential temperature region of 100 K or more in a supercooled liquid phase represented by the difference $\Delta T$ ($=T_x-T_g$) between a crystallizing point $T_x$ and a glass transition point $T_g$. In the formula, each marks a–c is the atomic ratio of the respective element A–C under the conditions of a=5–20, b=15–45, c≦10 and a+b+c=30–70. If the metamorphosing potential is not enough, an obtained Zr alloy would have the structure that a crystallized phase is mixed in the amorphous phase.

DETAILED DESCRIPTION OF THE INVENTION

Figure 1:
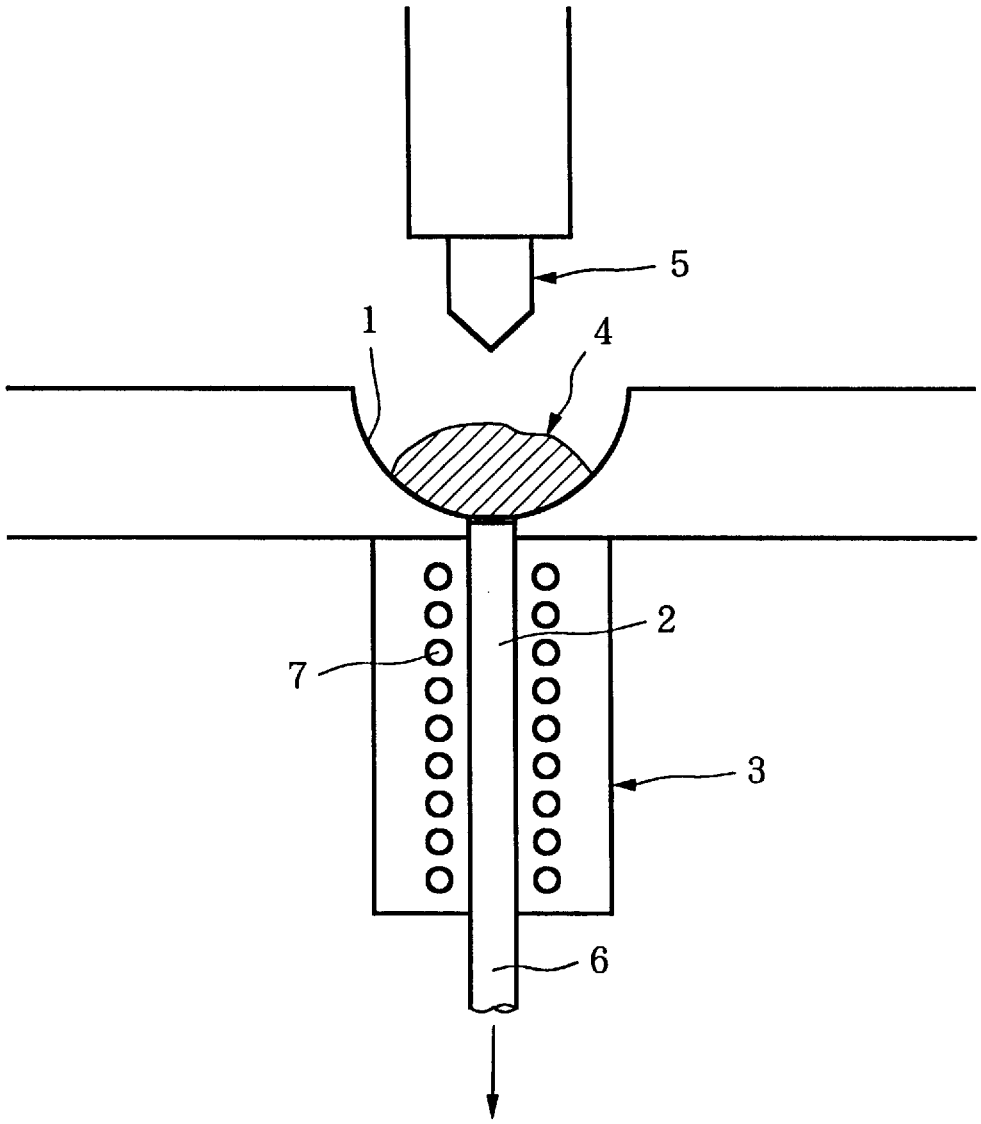
FIG. 1 is a view for explaining one example of a casting-forming device to be used in the present invention.

In the general formula of $Zr_{100-a-b-c}A_aB_bC_c$, the mark A represents one or more elements selected from the group of Ti, Hf, Al and Ga, having the function to broaden the differential temperature region in the supercooled liquid phase without reducing the metamorphosing potential. Especially, Al and/or Ga is preferable as the element A. If the amount of the element A added to the Zr alloy is less than 5 atomic % or more than 20 atomic %, the differential temperature region ΔT in the supercooled liquid phase would be smaller than 100 K. In addition, the obtained Zr alloy would show poor plastic workability.

The mark B represents one or more elements selected from the group of Fe, Co, Ni and Cu, having the function to promote the formation of the amorphous phase. When the amount of the element B is within the range of 15–45 atomic %, the alloy system has a sufficient metamorphosing potential.

The mark C represents one or more elements selected from the group of Pd, Pt, Au and Ag, having the function to suppress the formation and growth of crystal seeds in the amorphous phase without reducing the metamorphosing potential or the broad supercooled liquid region. Especially, Pd and/or Pt is preferable as the element C. Pd, Au and Ag are effective in improving the solderability of the obtained amorphous Zr alloy, too.

Since the element C exhibits extremely high chemical stability in general, the element C has the function to inhibit the formation of oxides caused by the reaction of the other elements with residual oxygen. Consequently, the irregular formation of crystal seeds due to the oxides serving as seeds is inhibited, so as to facilitate the metamorphosing of the Zr alloy. In addition, the element C excellent in thermal conductivity promotes the thermal diffusion of the molten Zr alloy, resulting in the enhancement of the cooling speed. Consequently, the metamorphosing potential of the Zr alloy is improved in the casting method according to the present invention, and it is possible to provide a broad supercooled liquid phase region suitable for plastic working.

When the amount of the element C is 0 atomic %, a lot of crystal seeds are easily formed in the amorphous phase. The crystal seeds grow up to a crystalline phase which would cause the formation of crackings during plastic working in the succeeding step. When the amount of the element C exceeds 10 atomic %, the Zr alloy would show the tendency to reduce its metamorphosing potential.

Furthermore, the elements A–C are preferably added to the Zr alloy under the condition of a+b+c=30–70 atomic %. If the condition of a+b+c=30–70 atomic % is not satisfied, the formation and growth of a crystal phase would be facilitated so as not to obtain a predetermined amorphous phase.

The amorphous Zr alloy according to the present invention exhibits excellent plastic workability, when the differential temperature region ΔT in the supercooled liquid phase represented by the temperature difference between the crystallization point $T_x$ and the glass transition point $T_g$ is adjusted to a value not less than 100 K. The differential temperature region ΔT of 100 K or more can be attained by combinatively controlling the amount of each element A–C. The Zr alloy according to the present invention remarkably reduces in the supercooled liquid phase region, so that the Zr alloy can be plastically deformed to an objective shape without the formation of crackings or other faults.

The obtained rod-shaped or tubular amorphous Zr alloy preferably comprises an amorphous phase of 50–100% in volume, while the remaining crystal phase is of 100 μm or less in grain size. When the amorphous phase is 50% or more in volume, a high-quality product free from faults is obtained without the formations of cracks originated in the crystal phase during platic working. The cracking derived from the crystal phase during plastic working can be inhibited by controlling the crystal phase below 100 μm or less in grain size. According to the present invention as aforementioned, it is possible to obtain an amorphous Zr alloy having a rod-shaped or tubular configuration of 50 $mm^2$ or more in cross section. Due to the large cross section, the obtained Zr alloy can be formed to a final product at a high yield ratio and a saved production cost.

According to the present invention, a forced-cooled die 3 having a cavity 2 corresponding to the profile of a product is located on the bottom of a melting hearth 1 having an opened upper surface, in order to cast a rod-shaped or tubular amorphous Zr alloy having a large cross section. The forced-cooled die 3 is preferably made of copper or copper alloy having large heat capacity and excellent thermal conductivity. Although the cross section of the cavity 3 can be arbitrarily determined in response to the profile of a product, a columnar or tubular cross section is preferable accounting the industrial use of the cast body. When a rod-shaped cast body is to be obtained, the columnar cavity 2 is formed in the die 3. When a tubular cast body is to be obtained, a proper core (not shown) is inserted into the cavity 2.

A solid-phase alloy material 4 is received i n the melting hearth 1, and melted by a heat supplied from a heat supply source 5. The alloy material 4 may be one having an arbitrary shape such as rod, pellets or powder and having properly controlled composition. In order to rapidly heat and melt the alloy material 4, the heat supply source 5 may be preferably a high-frequency heater, arc discharger, electron beam irradiator, laser beam irradiator or infrared irradiator capable of concentratedly applying energy to a determined point with high energy density.

After the alloy material 4 is completely melted, the heat supply from the heat source 5 is stopped. The resulting melt is transferred from the melting hearth 1 to the cavity 2 defining the profile of a cast body. During the transfer of the melt, it is necessary to prevent the moving melt from solidification: otherwise the gate of the cavity 2 would be clogged by the solidified alloy. In this regard, it is preferable to insert a melt carrier 6 in the Profile defining cavity 2 during heating and melting. When the melt carrier 6 is withdrawn from the cavity 2 immediately after the completion of melting, the molten Zr alloy is transferred to the cavity 2. The melt carrier 6 is made of copper or copper alloy as same as the die 3 and preferably driven by a hydraulic cylinder, a gas cylinder or a suction power using vacuum or decompression.

The molten Zr alloy is rapidly cooled and solidified by cooling water circulating through a passage 7 formed in the die 3. The gas cooling system wherein a low-temperature liquified gas or the like is circulated in the die may be adopted instead of the water cooling system. The molten Zr alloy is metamorphosed to an amorphous state by said forced cooling.

The solidified amorphous Zr alloy is withdrawn from the profile defining cavity 2 preferably at a speed of 1–50 mm/sec. By the withdrawal of the amorphous Zr alloy along the longitudinal direction of the cavity 2, a product having a predetermined rod or tubular shape is continuously produced.

samples were deformed to a high-quality product having the structure wherein crackings caused by the deformation were not observed since their viscocity was sufficiently lowered in the overcooled liquid phase reigion. On the other hand, since Group-B samples contained the crystal phase of 50% or more in volume, a body reformed from any Group-B sample had the structure including cracks caused by the deformation of the crystal phase so that the cast body was not offered as a valuable product.

TABLE 1

PROPERTIES OF OBTAINED AMORPHOUS ALLOY

| | SAMPLE NO. | ALLOYING COMPOSITION (atomic %) | SHAPE OF SAMPLE*1 ROD | SHAPE OF SAMPLE*1 TUBE | TEMP. REGION ΔT*2 (°C.) | CRACKS DURING DEFORMATION |
|---|---|---|---|---|---|---|
| PRESENT INVENTION | A1 | $Zr_{50}Al_5Cu_{35}Ni_7Pt_3$ | ○ | ○ | 120 | no |
| | A2 | $Zr_{55}Al_{10}Cu_{25}Ni_7Pt_3$ | ○ | ○ | 115 | no |
| | A3 | $Zr_{50}Al_{10}Cu_{25}Pt_4Au_1$ | ○ | ○ | 112 | no |
| | A4 | $Zr_{52}Al_{10}Ni_{10}Cu_{15}Pt_3$ | ○ | ○ | 105 | no |
| | A5 | $Zr_{55}Al_{10}Ti_5Cu_{25}Pt_5$ | ○ | ○ | 108 | no |
| | A6 | $Zr_{60}Al_{10}Ni_7Cu_{15}Co_3Pt_5$ | ○ | ○ | 118 | no |
| | A7 | $Zr_{60}Al_5Cu_{32}Pd_3$ | ○ | ○ | 114 | no |
| | A8 | $Zr_{60}Al_{10}Ni_{10}Cu_{17}Pd_2Ag_1$ | ○ | ○ | 115 | no |
| | A9 | $Zr_{60}Al_{10}Ni_{10}Cu_{15}Pd_5$ | ○ | ○ | 119 | no |
| | A10 | $Zr_{50}Al_{15}Ni_{10}Cu_{15}Co_5Pd_5$ | ○ | ○ | 121 | no |
| COMPARATIVE EXAMPLES | B1 | $Zr_{80}Al_5Cu_{10}Pd_5$ | X | X | — | no |
| | B2 | $Zr_{65}Al_3Cu_{27}Pd_5$ | X | X | 68 | no |
| | B3 | $Zr_{50}Al_{25}Cu_{20}Pd_5$ | X | X | 87 | no |
| | B4 | $Zr_{60}Al_{10}Cu_{30}$ | X | X | 61 | no |
| | B5 | $Zr_{50}Al_{10}Cu_{20}Pt_{20}$ | X | X | 35 | no |

Note
1) The mark ○ represents the sutructure containing an amorphous phase of 50% or more in the volume The mark X represents the structure containing a crystal phase of 50% or more in volume.
2) The temperature region ΔT in the supercooled liquid phase is represented by the temperature difference between a crystallization point $T_x$ and a glass transition point $T_g$.

EXAMPLE

Each material having the alloying composition indicated in Table 1 was heated and melted by arc discharge using the apparatus shown in FIG. 1. The molten Zr alloy was cast to a rod-shaped body of 16 mm in diameter, 201 $mm^2$ in cross section and 50 mm in length and a tubular body of 16 mm in outer diameter, 8 mm in inner diameter, 151 $mm^2$ in cross section and 50 mm in length. Hereon, the melt carrier 6 is driven by the suction power of an evacuator (not shown).

The amorphous phase of each obtained sample was investigated by X-ray analysis, while the differential temperature region ΔT in the supercooled liquid phase and the volume ratio of the amorphous phase were measured by a differential scanning calorimeter. The plastic workability of each sample was researched as follows: A rod-shaped sample was heated at a glass transition point $T_g$, a pressure was applied to the heated sample along the longitudinal direction to deform the sample. Thereafter, the formation of cracks in the deformed sample was observed by a microscope.

Table 1 shows the results of these researches.

It is noted from Table 1 that any of the rod-shaped or tubular samples belonging to Group-A having the composition according to the present invention had the structure containing an amorphous phase of 50% or more in volume. On the contrary, Group-B samples had the structure containing a crystal phase of 50% or more in volume due to its poor metamorphosing potential. The deformation test in the supercooled liquid phase region showed that Group-A According to the present invention as aforementioned, a melting and solidifying step is controlled in combination with die casting and a heat source, so as to obtain an amorphous Zr alloy having the large volumetric ratio of an amorphous phase. Since a Zr alloy having controlled composition shows extremely high metamorphosing potential and a broad supercooled liquid phase region, the Zr alloy can be formed to a product valuable for various practical uses. Especially, an amorphous material having a large cross section can be plastically worked to an objective shape applicable to various parts at remarkably saved producing costs. The product obtained in this way can be used in various industrial fields including the use as cans or control rods for an atomic reactor, various kinds of dies, filaments for electric lamps and so on, utilizing the intrinsic properties of the amorphous Zr alloy excellent in mechanical strength, heat resisitance and corrosion reistance.

What is claimed is:

1. A Method of manufacturing a rod-shaped or tubular amorphous Zr alloy, comprising:

providing a forced-cooled die at the bottom of a melting hearth, said melting hearth having an opened upper surface, said die having a cavity defining the profile of a cast body;

melting a Zr alloy containing at least one noncrystallizing element in said melting hearth;

transferring the molten Zr alloy into said forced-cooled die; and rapidly cooling and solidifying said molten Zr alloy in said forced-cooled die so as to transform said Zr alloy to an amorphous phase.

2. The method according to claim 1, wherein the Zr alloy containing at least one noncrystallizing element is heated and melted by high-density energy beams.

3. A method of manufacturing a rod-shaped or tubular amorphous Zr alloy, comprising:

providing a forced-cooled die at the bottom of a melting hearth, said melting hearth having an opened upper surface, said die having a cavity defining the profile of a cast body;

inserting a melt carrier into said cavity of the die;

melting a Zr alloy containing at least one noncrystallizing element in said melting hearth;

transferring the molten Zr alloy into said forced-cooled die;

rapidly cooling and solidifying said molten Zr alloy in said forced-cooled die, while withdrawing said melt carrier from the cavity of the die so as to continuously metamorphose said Zr alloy to an amorphous phase.

4. The method according to claim 3, wherein the melt carrier has a cross section corresponding to the cavity of the forced-cooled die.

5. The method according to claims 1, using a water-cooled or gas-cooled die as the forced-cooled die.

6. The method according to claim 1, using a Zr alloy containing one or more noncrystallizing elements selected from the group consisting of Ni, Cu, Fe, Co, Pd, Pt, Hf, Au, Ag, Ti, Al and Ga.

7. A method of manufacturing a rod-shaped or tubular amorphous Zr alloy, comprising:

providing a forced-cooled die at the bottom of a melting hearth, said melting hearth having an opened upper surface, said die having a cavity defining the profile of a cast body;

putting a Zr alloy material having the composition represented by the general formula of $Zr_{100-a-b-c}A_aB_bC_c$ (wherein A is one or more elements selected from Ti, Hf, Al and Ga, B is one or more elements selected from Fe, Co, Ni and Cu, C is one or more elements selected from Pd, Pt, Au and Ag, and each subscript a–c represents the atomic ratio of the respective element A–C under the conditions of a=5–20, b=15–45, $c \leqq 10$ and a+b+c=30–70) and having the temperature difference $\Delta T$ ($=T_x-T_g$) of 100 K or more in an overcooled one wherein $T_x$, represents a crystallization point $T_x$ and $T_g$ represents a glass transition point on said hearth;

melting said Zr alloy in said melting hearth;

transferring the molten Zr alloy into said forced-cooled die; and rapidly cooling and solidifying said molten Zr alloy in said forced-cooled die so as to transform said Zr alloy to an amorphous phase.

8. The method according to claim 3, using a water-cooled or gas-cooled die as the forced-cooled die.

9. The method according to claim 3, using a Zr alloy containing one or more noncrystallizing elements selected from the group consisting of Ni, Cu, Fe, Co, Pd, Pt, Hf, Au, Ag, Ti, Al and Ga.

* * * * *

UNITED STATES PATENT AND TRADEMARK OFFICE

CERTIFICATE OF CORRECTION

PATENT NO. : 5,803,996

DATED : September 8, 1998

INVENTOR(S) : Akihisa Inoue et al.

It is certified that error appears in the above-identified patent and that said Letters Patent is hereby corrected as shown below:

Column 1 Line 10 between "for" and "artificial" delete --an--.

Column 1 Line 27 "exsists" should read --exists--.

Column 1 Line 38 "Combinated" should read --Combined--.

Column 2 Line 52 "restriction" should read --restrictions--.

Column 2 Line 66 "each marks" should read --each mark--.

Column 4 Line 16 "platic" should read --plastic--.

Column 4 Line 55 delete colon ":" and insert semicolon --;--.

Column 4 Line 57 "Profile" should read --profile--.

Column 4 Line 62 "as same as" should read --the same as--.

Column 6 Line 3 "viscocity" should read --viscosity--.

Column 6 Line 4 "reigion" should read --region--.

Column 6 Table 1, under column headed "Alloying Composition", refer to row "A3": "$Zr_{50}$" should read --$Zr_{60}$--.

Column 6 Table 1, under column headed "Alloying Composition", refer to row "A4": "$Zr_{52}$" should read --$Zr_{62}$--.

Column 6 Table 1, last column, under rows identified as "B1", "B2", "B3", "B4" and "B5": "no" should read --do--.

UNITED STATES PATENT AND TRADEMARK OFFICE

CERTIFICATE OF CORRECTION

PATENT NO. : 5,803,996

DATED : September 8, 1998

INVENTOR(S) : Akihisa Inoue et al.

It is certified that error appears in the above-identified patent and that said Letters Patent is hereby corrected as shown below:

Column 6 Table 1, under Note 1): "sutructure" should read --structure--.

Column 6 Table 1, under Note 1): "in the volume" should read --in volume--.

Column 6 Line 55 "heat resisitance" should read --heat resistance--.

Column 6 Line 55 "corrosion reistance" should read --corrosion resistance--.

Claim 1 Column 6 Line 57 "A Method" should read --A method--.

Claim 5 Column 7 Line 26 "claims 1" should read --claim 1--.

Claim 7 Column 8 Line 15 "one" should read --zone--.

Claim 7 Column 8 Line 17 "$T_x$, represents" should read --$T_x$ represents-- (delete comma).

Signed and Sealed this

Sixteenth Day of February, 1999

*Attest:*

*Attesting Officer*

*Acting Commissioner of Patents and Trademarks*